US005297786A

United States Patent [19]

LaChapelle et al.

[11] Patent Number: 5,297,786

[45] Date of Patent: * Mar. 29, 1994

[54] CLEATED WHEEL ASSEMBLY AND METHOD OF SEPARATING A SHEET USING A CLEATED WHEEL ASSEMBLY

[75] Inventors: Philip S. LaChapelle, Tega Cay; Ralph S. Goldstein, Lake Wylie, both of S.C.

[73] Assignee: Roberts Systems, Inc., Charlotte, N.C.

[ * ] Notice: The portion of the term of this patent subsequent to Sep. 8, 2009, has been disclaimed.

[21] Appl. No.: 893,727

[22] Filed: Jun. 4, 1992

Related U.S. Application Data

[63] Continuation-in-part of Ser. No. 788,535, Nov. 6, 1991, Pat. No. 5,145,162.

[51] Int. Cl.[5] ..... B65H 3/06

[52] U.S. Cl. ..... 271/119; 271/122

[58] Field of Search ..... 271/118, 119, 122

[56] References Cited

U.S. PATENT DOCUMENTS

| | | | |
|---|---|---|---|
| 1,626,386 | 4/1927 | Bronander | 271/119 |
| 3,888,479 | 6/1975 | Eder et al. | 271/119 X |
| 4,496,145 | 1/1985 | Fukui | 271/122 |
| 4,715,597 | 12/1987 | Sakurai | 271/122 |
| 4,779,861 | 10/1988 | Ozawa et al. | 271/119 |
| 4,871,162 | 10/1989 | Imai et al. | 271/122 X |
| 4,958,825 | 9/1990 | Onomoto et al. . | |
| 4,981,235 | 1/1992 | Ferrini et al. . | |
| 5,145,162 | 9/1992 | LaChapelle et al. | 271/122 X |

*Primary Examiner*—D. Glenn Dayoan
*Assistant Examiner*—Boris Milef
*Attorney, Agent, or Firm*—Hardaway Law Firm

[57] ABSTRACT

A process and apparatus for a cleated wheel assembly for aligning and securing a cleat to the outer circumference of a wheel which provides a cleat having attachment apertures which are secured by dowel pins within spaced receptacles, defined within the outer wheel rim, with mated plugs securing the cleat within the spaced receptacles. The assembly comprises a cleated wheel and a second wheel, the two wheels rotating in opposite direction, in order for the cleated wheel to separate a single article from a stack of articles, the second wheel preventing the next sequential article from leaving the stack.

5 Claims, 2 Drawing Sheets

CLEATED WHEEL ASSEMBLY AND METHOD OF SEPARATING A SHEET USING A CLEATED WHEEL ASSEMBLY

CROSS REFERENCE TO A RELATED APPLICATION

This is a continuation-i-part of application Ser. No. 07/788,535, filed Nov. 06, 1991, now U.S. Pat. No. 5,145,162 and incorporated herein by reference.

BACKGROUND OF THE INVENTION

The present invention is directed to a cleated wheel assembly used to bias a single article from a stack of like articles.

Individual cleated wheels are known in the art for biasing articles. U.S. Pat. No. 4,981,235 to Ferrini and U.S. Pat. No. 4,958,825 to Onomoto, et al. disclose the use of a cleated wheel for separating individual items from a stack of items. Onomoto also discloses the use of a frictional member distal to the cleated wheel to prevent the conveyance of the next adjacent article.

Two or more cleated wheels are often used in cooperation to engage and bias a single piece of blank stock. As a result, it is important that the cooperating cleats present uniform surfaces and be installed within narrow tolerances of one another. Even small deviations in the operator technique of installing and replacing cleats upon the outer surface of a wheel can result in inefficient feeding, damaged stock, as well as creating uneven wear of the cleats.

The securing means used to attach cleats to the outer rim of the wheel are themselves subject to wear and require periodic maintenance. Since a cleated wheel is often one of many wheels or rollers carried by a given drive shaft, removal of a cleated wheel has heretofore required removal of numerous other attachments carried by the same axle. Such removal results in extensive and costly machine down time. Thus, there is a need for improvement within the art.

SUMMARY OF THE INVENTION

It is an object of this invention to provide a cleated wheel apparatus which can remove a single article from a stack of similar articles.

It is a further object of this invention to provide a cleated wheel apparatus in which the wheels are responsive to a servo regulator.

It is a further object of this invention to provide a cleated wheel apparatus which simplifies cleat replacement.

It is a further object of this invention to provide a cleated wheel apparatus which provides aligning means for positioning a cleat upon the surface of a wheel.

These as well as other objects of the invention are provided by an apparatus for separating a single article from a stack of similar articles comprising a roller having a first wheel and a second wheel, the second wheel adjacent to the first wheel and carrying a cleat upon an outer rim; means for rotating the first wheel in a first direction and rotating the second wheel in a second direction counter to that of a first wheel; wherein the cleat of the second wheel engages a first article from a stack of similar articles, biasing the first article in a first direction while the first wheel applies an opposing securing force to the second sequential article in the stack.

The shaft driven cleated wheel assembly further comprises a cleat having a top, a bottom, a first terminus and a second terminus, the two terminal ends both defining a separate aperture therethrough in communication with the cleat top and the cleat bottom; a wheel, having a circular rim, the wheel further defining two spaced receptacles in communication with the rim; a pair of plugs, each plug companionately mated to a corresponding receptacle; alignment means for positioning the respective cleat terminus end within the respective receptacles, the alignment means further providing a means of positioning the plugs within the respective receptacle; securing means for attaching the plug to the receptacle, thereby fastening the cleat to the rim wheel.

DETAILED DESCRIPTION

In accordance with this invention, it has been found that a bi-directional multiple wheeled roller can be provided which has a cleat carried on a first roller wheel which engages a stack of carton blank stock. As the cleated surface rotates, a single article of carton blank stock is biased by the cleat in a first direction. As the cleat disengages from the article, an adjacent smooth surfaced wheel, rotating in a direction opposite that of the first wheel, engages the next sequential article thereby providing an engaging force which secures the sequential article until engaged by the next rotation of the cleated wheel.

While the description in the referenced patent application is given in reference to a carton blank conveyor, the bi-directional multiple wheeled roller has numerous applications. In accordance with this invention, it has been found that a cleated wheel apparatus and method can be provided which can efficiently remove a single article from a stack of similar articles. Such an apparatus and method is useful in apparatuses such as money dispensing machines, paper feeding devices such as copiers, and other types of sorting equipment where individual articles from a stack of similar articles must be individually removed and processed.

Figure 1:
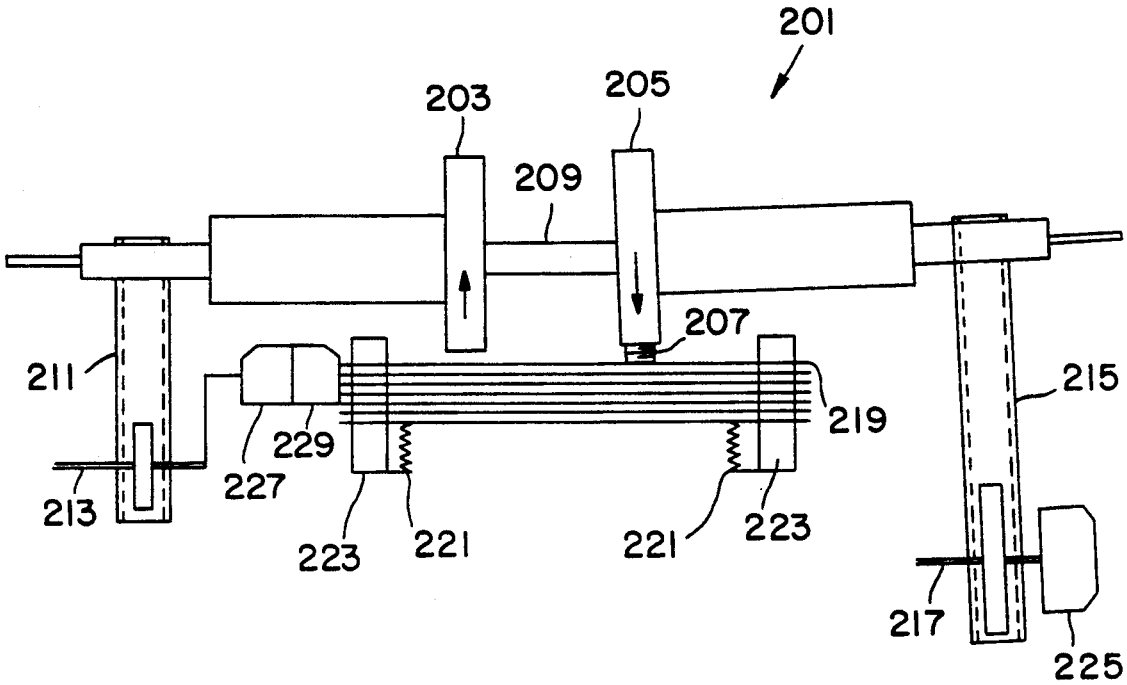
FIG. 1 of the drawings is an elevational view of a cleated wheel assembly.

As best seen in reference to FIG. 1, a cleated wheel assembly 201 has a smooth surfaced wheel 203, a cleated wheel 205 having a cleat 207 attached to its outer rim, the wheels being carried on an axle 209. Wheel 203 rotates in a first direction and is driven by a first belt 211 driven by a first drive means 213. Wheel 205 rotates in a second direction opposite that of wheel 203 and is driven by a second belt 215 driven by a second drive means 217. Wheel 203 has a diameter slightly greater than that of wheel 205.

Figure 3:
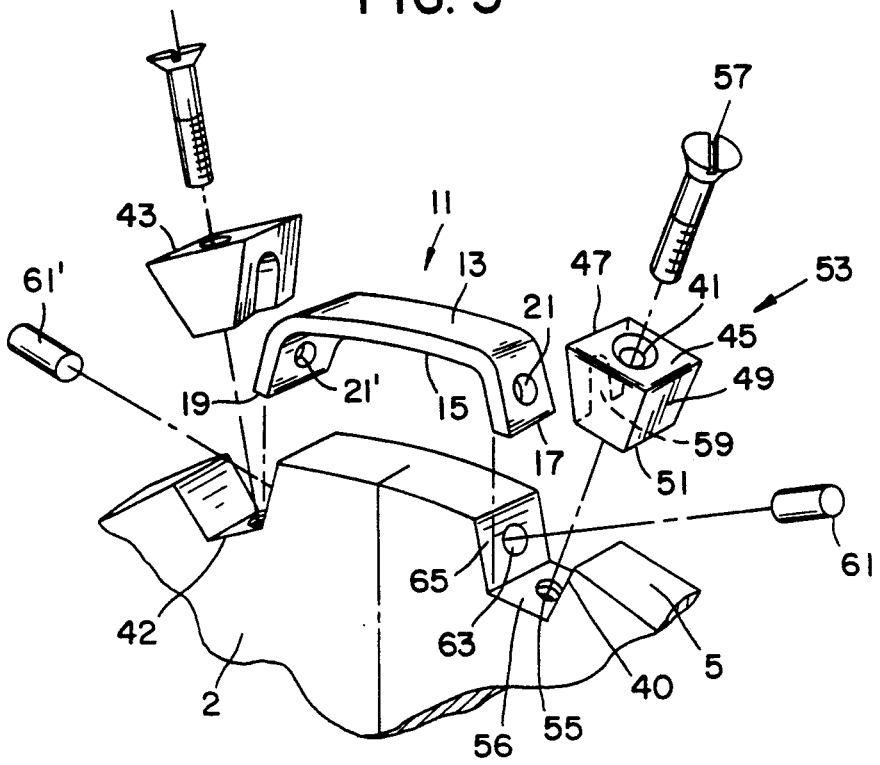
FIG. 3 of the drawings is an enlarged and exploded view of FIG. 1 showing additional details of construction.

Supported beneath wheel assembly 201 is a stack of articles 219 supported by flexible adjustable means 221 and retaining arms 223. Adjustable means 221 consists of springs, pistons or other means which permit the downward displacement of the retained articles 219 as the upper most article of the stack is engaged by cleat 207 of wheel 205. The displacement permits cleat 207 to engage and separate a single article 219 from the stack of similar articles without damaging the articles. Cleat 207 biases a single article 219 towards an adjacent receiving apparatus such as nip rollers best seen in FIG. 3 of the referenced earlier filed application.

As cleat 207 disengages from article 219, adjustable means 221 repositions stacked articles 219 such that the next sequential article is engaged only by smooth surfaced wheel 203. The engaging force of wheel 203 on the next sequential article prevents the simultaneous feeding of multiple articles. Retaining arms 223 provide a securing means for keeping articles 219 in place when engaged by rotating wheel 203.

Drive means 217 can be controlled by a servo regulator 225 thereby controlling the rotational speed of cleated wheel 205. A similar servo regulator 227 can control the speed of wheel 203 as well. This feature permits the servo regulation of one or more wheels of the assembly. For instance, the smooth surfaced wheel 203 may have independent drive means 213 responsive to a servo regulator 227. Accordingly, the smooth surfaced wheel's rotation could be limited to the interval when the first stacked article is being removed from the stack. By limiting the rotation to this time interval, the smooth surfaced wheel prevents the undesirable feeding of multiple articles while minimizing the risk of damaging sequential articles.

For some applications, it has been found that the frictional force supplied by the smooth surfaced wheel is of itself sufficient such that the counter rotation of the smooth surfaced wheel is unnecessary. Accordingly, a servo controlled uniform surface wheel 203 could rotate only in response to a signal from a sensor 229 that a misfeed has occurred. The smooth surfaced wheel is engaged in response to the signal to correct the misfeed by repositioning the next adjacent sheet. In such circumstances, having a separate servo drive mechanism for the cleated wheel permits the cleated wheel rotation to be interrupted while the uniform surface wheel corrects the misfeed.

These features permit the rollers to engage single articles from a stack of like articles which may have a variety of orientation. For instance, the cleated wheel assembly can engage single articles from the top, bottom, or the side of a stack of items. Further, such stacks of articles can be presented in a shingled fashion as well.

A cleated wheel apparatus can also be provided which greatly simplifies the maintenance and replacement of cleats used in cleated wheel assemblies for biasing liners and/or carton blank stock. In addition, the apparatus permits lateral movement of the wheel upon an axis thereby allowing optimal placement of the cleat upon the stock surface. Further, the cleated wheel readily detaches from the supporting axis, simplifying maintenance.

Figure 2:
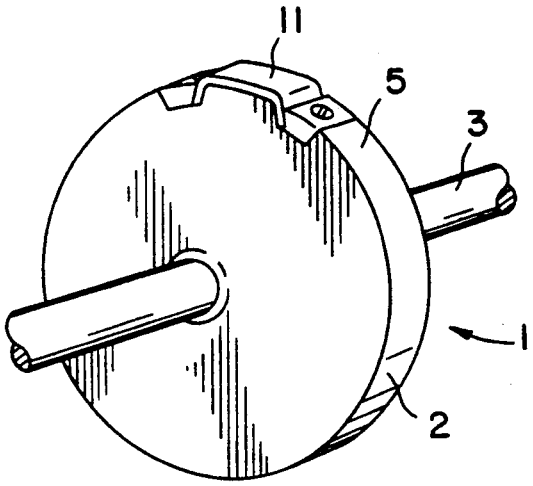
FIG. 2 of the drawings is a perspective view of a cleated wheel.

In reference to a preferred embodiment seen in FIG. 2, a cleated wheel assembly 1 is comprised of a wheel 2 carried on a drive shaft 3. For clarity of illustration, a smooth surfaced wheel is not shown. Attached to an outer circumferential rim 5 is a cleat 11. Cleat 11, as best seen in FIG. 2, has an upper surface 13, a lower rim engaging surface 15, a first terminus 17 and a second terminus 19, each terminus further defining an aperture 21 and 21' respectively. Preferably, cleat 11 is constructed of a fabric-backed rubber composition which has sufficient structural strength and provides an effective rubber upper surface 13 for engaging blank stock.

Wheel 2 further defines a first receptacle 40 and a second receptacle 42 in communication with rim 5. A first wedge-shaped plug 41 and a second wedge-shaped plug 43, companionately mated to corresponding receptacles 40 and 42 respectively, is further provided by wheel 2. While it is understood that plugs 41 and 43 and receptacles 40 and 42 have similar respective features, additional details are provided in reference to plug 41 and receptacle 40 only.

Plug 41 has an outer arcuate surface 45 which corresponds to the general curvature and surface of outer wheel rim 5. Sloping side walls 47 and 49 taper into the interior of wheel 2 terminating in a flat bottom plug wall 51. Plug 41 further defines a bore 53 in communication with plug surface 45 and flat wall 51. An oppositely spaced, aligned threaded bore 55 is defined within an interior engaging floor 56 of receptacle 40. Bore 55 is aligned with plug bore 53 so as to receive a threaded bolt 57, thereby providing securing means for attaching plug 41 to receptacle 40.

Receptacle side wall 65 further defines a dowel pin bore 63 for receiving a first end portion of a dowel pin 61. A second free end of dowel pin 61 is designed to engage a plug bore 59 defined by the corresponding plug wall 47 opposite receptacle side wall 65.

Dowel pins 61 and 61' are used to align cleat 11 to wheel 2. With dowel pins 61 and 61' engaging their respective dowel pin bores 63, the free ends of dowel pins 61 engages respective cleat apertures 21 and 21' thereby aligning cleat terminus 17 and cleat terminus 19 in receptacles 40 and 42 respectively.

Cleat 11 is further secured to wheel 2 by the engagement of plugs 41 and 43 into mated receptacles 40 and 42. When properly positioned, free end of dowel pin 61 will engage plug bore 59, thereby aligning threaded receptacle bore 55 with plug bore 53, allowing bolt 57 to fasten plugs 41 and 43 within receptacles 40 and 42.

While it is possible to secure the respective cleat ends directly to the alignment means and not provide any mated plugs, such an arrangement is not preferred since it would result in potentially hazardous openings in the rim of the wheel.

The preferred arrangement permits proper alignment of the cleat 11 upon wheel 2 and ensures that the desired alignment is maintained during the tightening of a plug to the mated receptacle. The dowel pin alignment and plug securing means enables reproducible results and tolerances to be maintained even though numerous operators may be involved in maintaining the cleated wheel assembly. As a result, cleat 11 can be replaced as needed while maintaining desired tolerances with other cooperating cleats. Therefore, variations in cleat installation attributed to individual operator technique are minimized. As a result, desirable cleat alignment tolerances are maintained enabling greater speed and efficiency of the associated machinery.

Figure 4:
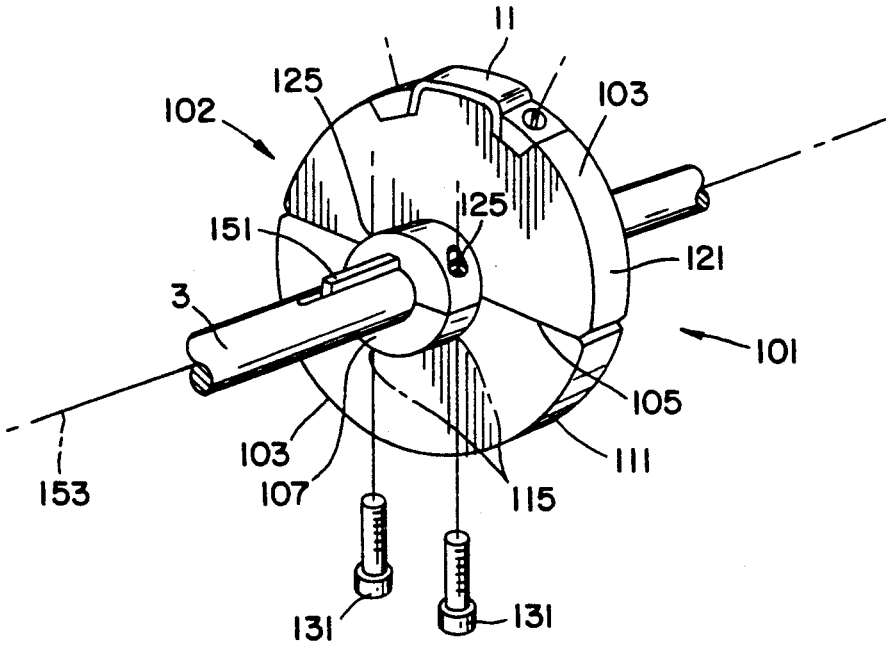
FIG. 4 of the drawings is a perspective view of a preferred embodiment of a split wheel design showing further a keyway provision.

An additional embodiment of the cleated wheel assembly 101 is provided as seen in reference to FIG. 4. Cleated wheel 102 is comprised of a first hemisphere 111 and a second hemisphere 121, each hemisphere defining an arcuate outer circumference 103 and a flat end wall 105. Wheel 102 further defines a reduced diameter hub 107 carried on either side of wheel 102, each hub 107 having a similar split hemisphere arrangement similar to wheel 102. Hub 107 defines a pair of bores 115 in communication with an arcuate hub surface of 1 hub hemisphere and a flat end wall of the opposite hub hemisphere.

Flat hub end wall of hemisphere 121 defines a pair of threaded bores 125 such that hub bores 125 and 115 are in opposite alignment when flat end wall 105 of paired hemispheres is properly positioned for wheel assembly.

Threaded bolts 131 are inserted into bores 115 of the hub associated with hemisphere 111 through the arcuate hub surface. Bolts 131, passing through flat hub end wall of hub hemisphere 111 are then used to secure the second hemisphere 121 through hub bores 125. Ideally, bores 115 allow threaded bolts 131 to be countersunk below the hub surface.

In the embodiment described above, cleat 11 attachment means (not pictured) are ideally situated entirely on either hemisphere thereby enabling wheel disassembly without the necessity of removing the cleat.

An additional desired feature, seen in reference to FIG. 4, is a keyway 151 defined along the length of wheel axis 153. The keyway permits the selective lateral movement of a cleated wheel upon the axis. This feature permits lateral movement of the wheel thereby enabling precise alignment of the cleated surface upon a desired region of carton blank stock.

It is thus seen that the present invention provides an improved cleated wheel assembly capable of separating single articles from a stack of similar articles and which provides for the precise alignment and securing means for installing replaceable cleats. Further, the cleated wheel is readily detachable from a drive shaft without the necessity for removal of other drive shaft components. In addition, the lateral positioning of cleated wheel on the drive shaft can be readily adjusted in response to the varying needs and requirements of the carton blank stock.

Many variations of the above invention may be apparent to those skilled in the art from a reading of the description which is exemplary in nature. Such variations are embodied within the spirit and scope of this invention as measured by the following appended claims.

That which is claimed:

1. An apparatus for separating a single article from a stack of articles comprising:

a roller having a first wheel and a second wheel, said second wheel adjacent to said first wheel and carrying a cleat upon an outer rim;

a first means for rotating said first wheel in a first direction and a second means for rotating said second wheel in a second direction counter to that of said first wheel;

wherein said cleat of said second wheel engages a first article from a stack of articles, biasing said first article in a first direction while said first wheel applies an opposing securing force to a second article.

2. The apparatus according to claim 1 further comprising:

adjustable means for displacing said stack in response to the engaging of said cleated wheel to said first article, said adjustable means repositioning said stack in contact with said first wheel.

3. A method of separating single articles from a stack of articles comprising the steps of:

providing a stack of articles;

positioning said stack in proximity to a multiple wheeled roller;

engaging said stack with said roller;

biasing a single article of said stack by the rotation of a cleated wheel of said roller;

engaging a sequential article of said stack with a second wheel of said roller.

4. The method according to claim 3 wherein aid second wheel rotates in a direction opposite of said cleated wheel.

5. The method according to claim 3 comprising the additional step of:

displacing said stack in response to the engagement of said stack by said cleated wheel.

* * * * *